US007959149B2

(12) United States Patent
Matsumoto

(10) Patent No.: US 7,959,149 B2
(45) Date of Patent: Jun. 14, 2011

(54) RECORDING APPARATUS

(75) Inventor: Toshiya Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 191 days.

(21) Appl. No.: 12/276,973

(22) Filed: Nov. 24, 2008

(65) Prior Publication Data

US 2009/0152803 A1 Jun. 18, 2009

(30) Foreign Application Priority Data

Dec. 14, 2007 (JP) ..... 2007-323327

(51) Int. Cl.
*B65H 1/00* (2006.01)

(52) U.S. Cl. ..... 271/162

(58) Field of Classification Search ..... 271/145, 271/157, 162, 164
See application file for complete search history.

(56) References Cited

U.S. PATENT DOCUMENTS

| | | | | |
|---|---|---|---|---|
| 6,776,405 | B2 * | 8/2004 | Eskey | 271/9.08 |
| 7,065,311 | B2 | 6/2006 | Okabe | |
| 7,648,135 | B2 * | 1/2010 | Matsushima | 271/171 |
| 2003/0052956 | A1 * | 3/2003 | Katsuyama | 347/108 |
| 2008/0099978 | A1 * | 5/2008 | Matsushima | 271/42 |

FOREIGN PATENT DOCUMENTS

| | | | |
|---|---|---|---|
| JP | 2006-036745 | A | 2/2006 |
| JP | 2006-297869 | A | 11/2006 |

* cited by examiner

*Primary Examiner* — Stefanos Karmis
*Assistant Examiner* — Thomas A Morrison
(74) *Attorney, Agent, or Firm* — Canon U.S.A. Inc., I.P. Division

(57) ABSTRACT

A recording apparatus has a paper cassette in which sheets are loaded and a cassette feeding roller that feeds the sheets. The paper cassette is configured to be inserted into the main body of the recording apparatus rearward from the front of the main body. The paper cassette can move between a first fixing position where the paper cassette is fully retracted within the main body and a second fixing position where the sheets positioned at the end of the paper cassette in the inserting direction into the main body can be fed by the cassette feeding roller.

8 Claims, 7 Drawing Sheets

RECORDING APPARATUS

BACKGROUND OF THE INVENTION

1. Field of the Invention

The present invention relates to a recording apparatus that performs recording on a recording medium.

2. Description of the Related Art

An ink jet recording apparatus disclosed in Japanese Patent Laid-Open No. 2006-36745 has a paper cassette that can be inserted from the front in a sliding manner and a U-turn conveying unit.

The recording apparatus has a feeding and separating unit in the inside. The feeding and separating unit separates the uppermost one of the sheets (recording media) loaded in the paper cassette and feeds the sheet to the U-turn conveying unit, toward the rear of the recording apparatus. The fed uppermost sheet is conveyed and caused to U-turn along the conveying path of the U-turn conveying unit. Thus, the conveying direction is changed to a direction toward the front of the recording apparatus.

Thereafter, the sheet is conveyed substantially horizontally from the U-turn conveying unit by a conveying roller provided in the front of the recording apparatus toward the front of the recording apparatus, to under a recording head disposed above the conveying roller. The recording head discharges ink onto the sheet, thereby recording an image. The sheet on which an image is recorded is discharged onto a paper output tray provided in a paper discharge unit in the front of the recording apparatus.

The recording apparatus has a second paper feeding unit above the U-turn conveying unit and can feed the sheets set in a paper feeding tray of the second paper feeding unit in preference to the sheets set in the paper cassette. So, it is possible to set frequently-used sheets (for example, plain paper) in the paper cassette, to set another kind of sheets (for example, gloss paper or postcards) in the paper feeding tray of the second paper feeding unit, and to preferentially feed the other kind of sheets. When the other kind of sheets are used, it is not necessary to take out the frequently-used sheets from the paper cassette and to then set the other kind of sheets in the paper cassette. Thus, the operability is improved.

A recording apparatus disclosed in Japanese Patent Laid-Open No. 2006-297869 has a document reader unit that has a document reading function. The document reader unit is mounted at the top of the recording apparatus and forward of a second paper feeding unit. This type of recording apparatus is called multifunction device.

The recording apparatus can store image data read by the document reader unit in a memory inside the recording apparatus, transmit the image data to a personal computer connected to the recording apparatus, or record the image data with the recording head of the recording apparatus. The document reader unit has a rotating shaft in the rear thereof. The rotating shaft is supported by the main body of the recording apparatus. By rotating the document reader unit upward around the rotating shaft, an operator can access the inside of the recording apparatus. So, the operator can easily replace ink or remove jammed paper. Thus, the ease of maintenance is improved.

In addition, the recording apparatus has a paper feeding tray and a paper output tray that can be retracted into and integrated with the main body of the recording apparatus when the recording apparatus is not used. So, space can be saved when the recording apparatus is stored. The retracted paper feeding tray and paper output tray are configured to block the openings of the second paper feeding unit and a paper discharge unit, respectively, thereby protecting the inside of the recording apparatus, for example, from the dust. Thus, the malfunction of the recording apparatus can be prevented.

FIGS. 5 to 7 are sectional views of conventional recording apparatuses.

A recording apparatus shown in FIG. 5 has a paper cassette 110 protruding forward from the main body of the recording apparatus and a second paper feeding unit 180 protruding rearward. So, the recording apparatus requires a large installation space.

A recording apparatus shown in FIG. 6 has a paper cassette 210 and a second paper feeding unit 280 each not protruding from the main body of the recording apparatus. So, the installation space of the recording apparatus is reduced. However, since the paper cassette is disposed in the rear, the recording apparatus has a U-turn conveying unit 240 with a lengthened sheet-conveying path and therefore has a low recording speed compared to the recording apparatus shown in FIG. 5.

A recording apparatus shown in FIG. 7 has a recording head 360 disposed in the rear of the recording apparatus and therefore has a U-turn conveying unit 340 with a short sheet-conveying path. So, the recording speed is improved without increasing the installation space of the recording apparatus. However, the recording head 360 disposed in the rear of the recording apparatus reduces the ease of access to the inside of the recording apparatus, thereby reducing the ease of maintenance such as replacement of ink and removal of jammed paper. In addition, since the recording head 360 is disposed in the rear of the recording apparatus, it is difficult to install a second paper feeding unit. When a different kind of sheets from the sheets set in a paper cassette 310 are used, it is necessary to take out the set sheets from the paper cassette 310 and to then set the different kind of sheets in the paper cassette 310. Thus, the operability is deteriorated.

SUMMARY OF THE INVENTION

The present invention provides a recording apparatus that has a space-saving footprint without sacrificing the recording speed, ease of maintenance, and operability.

In an aspect of the present invention, a recording apparatus includes a feeding unit that feeds recording media, and a loading unit in which recording media are loaded. The loading unit is capable of moving between a first position where the loading unit is fully retracted within the main body of the recording apparatus and a second position where the recording media loaded in the loading unit can be fed by the feeding unit.

Further features of the present invention will become apparent from the following description of exemplary embodiments with reference to the attached drawings.

DESCRIPTION OF THE EMBODIMENTS

The embodiment of the present invention will now be described with reference to the drawings.

Figure 1:
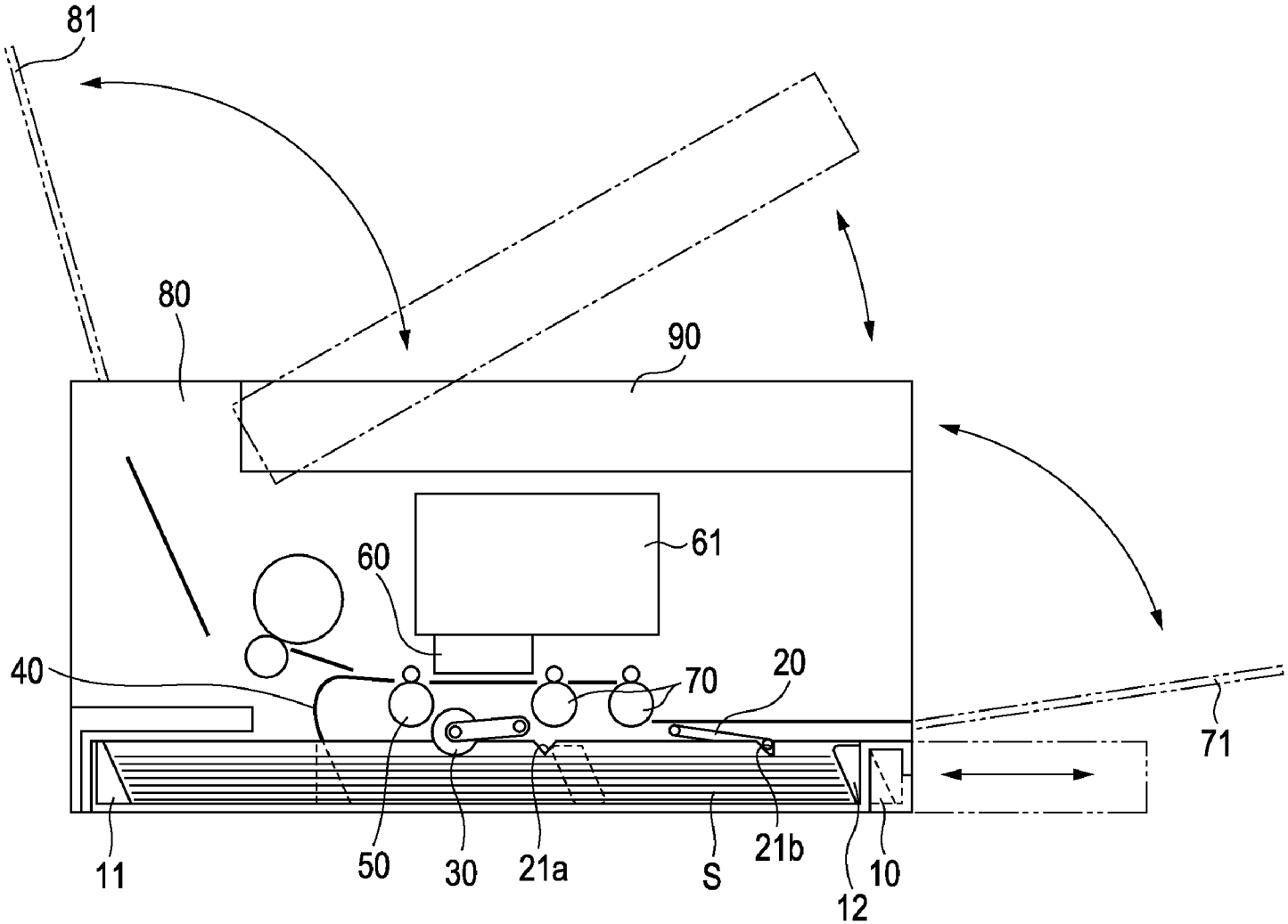
FIG. 1 is a side sectional view of a recording apparatus according to an embodiment of the present invention.
Figure 2:
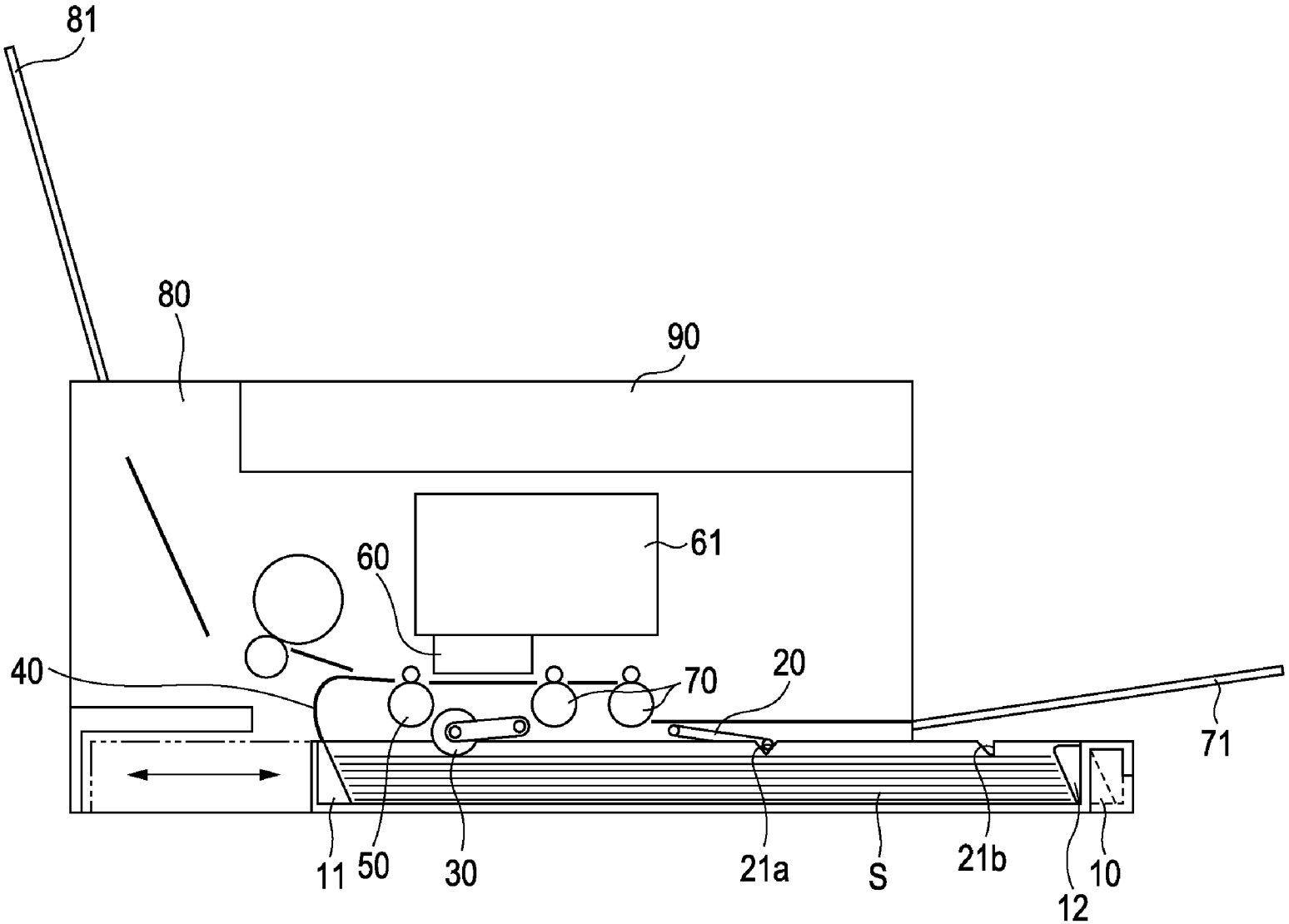
FIG. 2 is a side sectional view of a recording apparatus according to an embodiment of the present invention.
Figure 3:
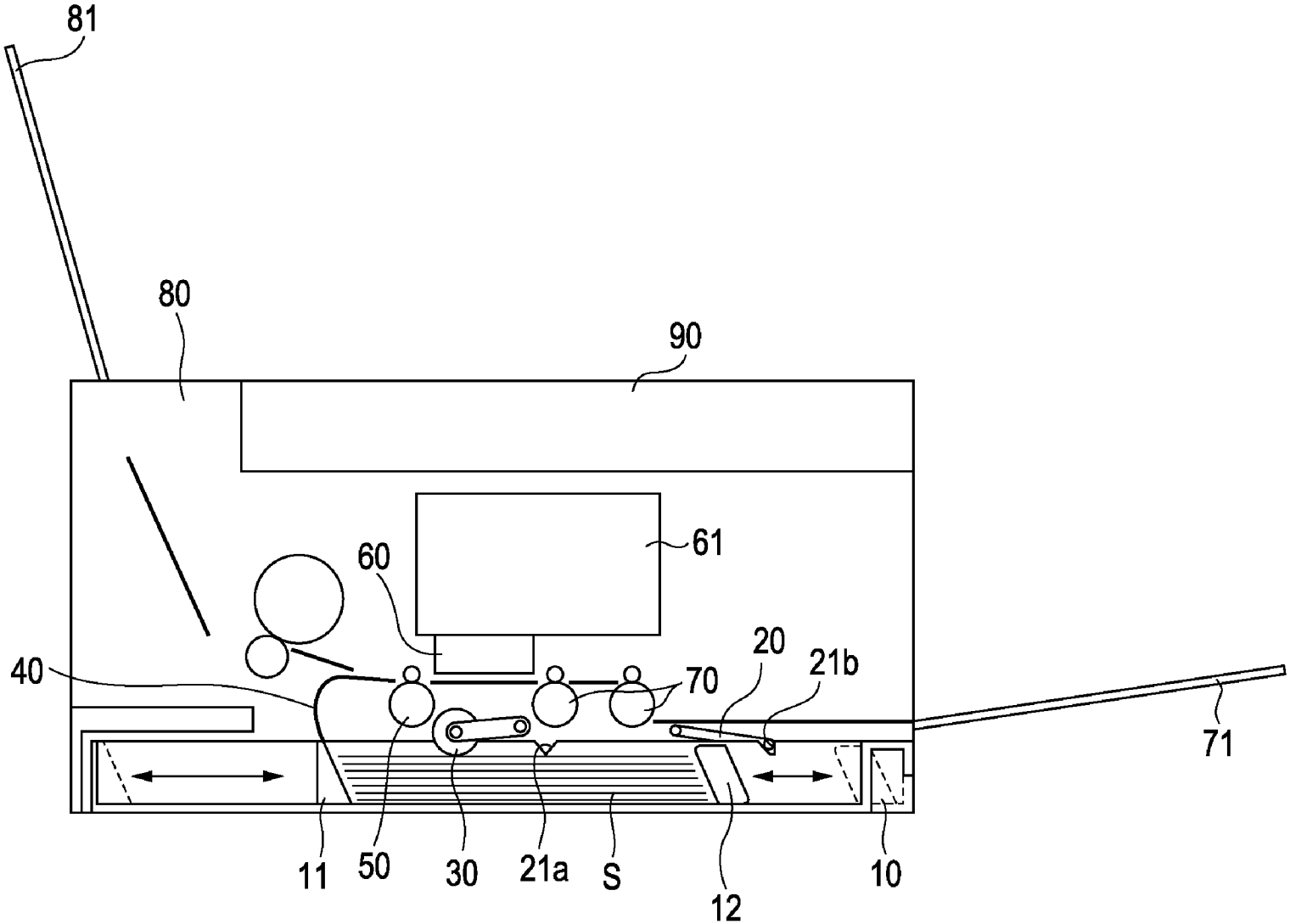
FIG. 3 is a side sectional view of a recording apparatus according to an embodiment of the present invention.
Figure 4:
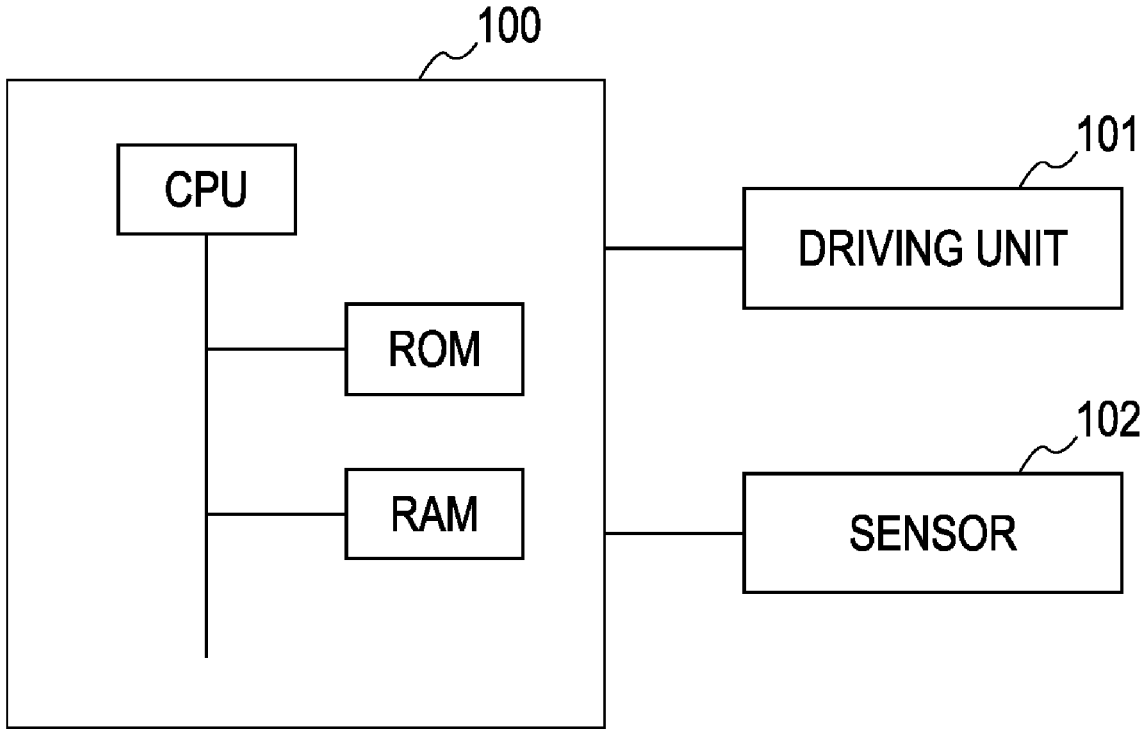
FIG. 4 is a block diagram of a recording apparatus according to the present invention.
Figure 5:
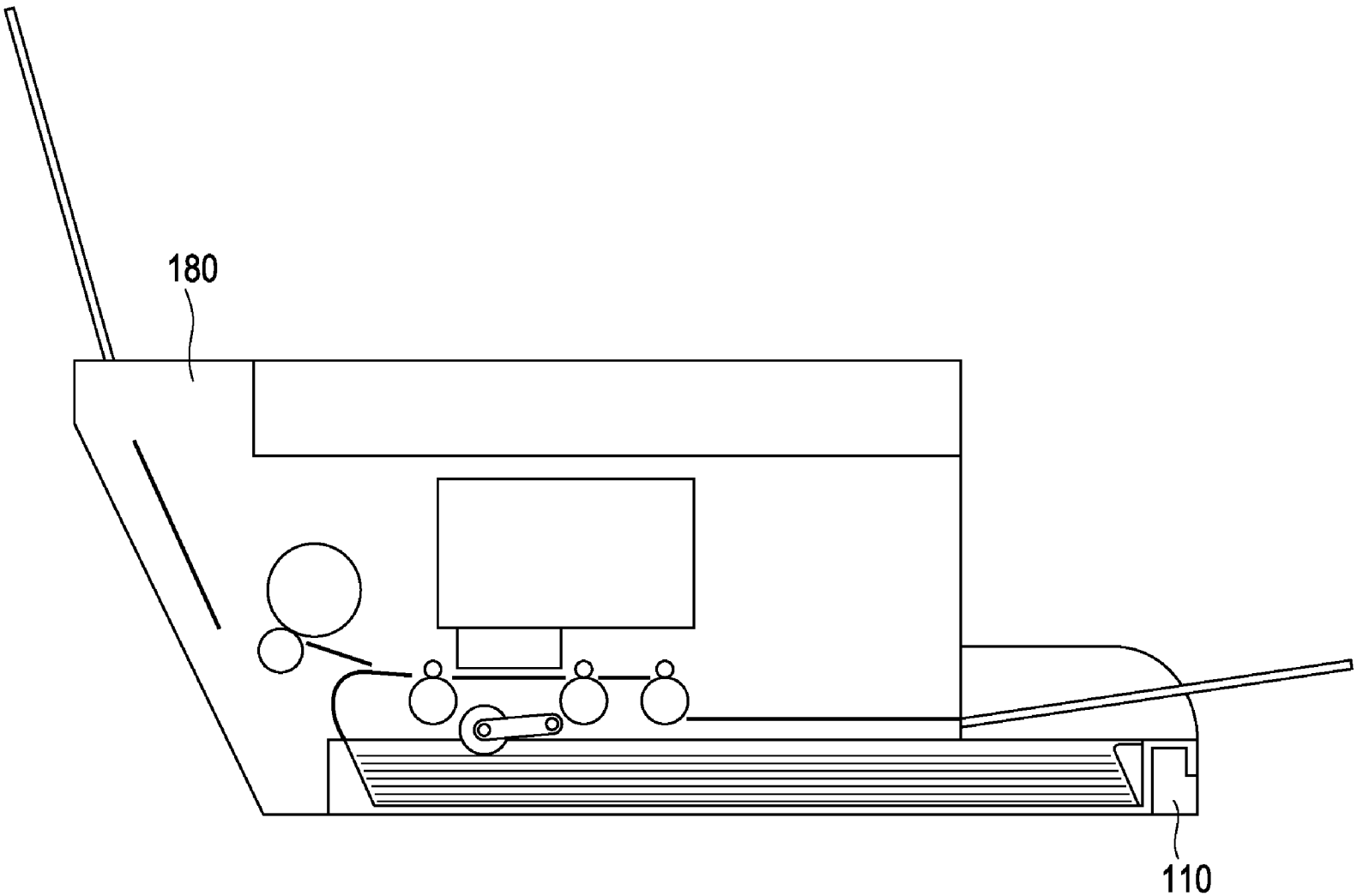
FIG. 5 PRIOR ART
FIG. 5 is a side sectional view of a conventional recording apparatus.
Figure 6:
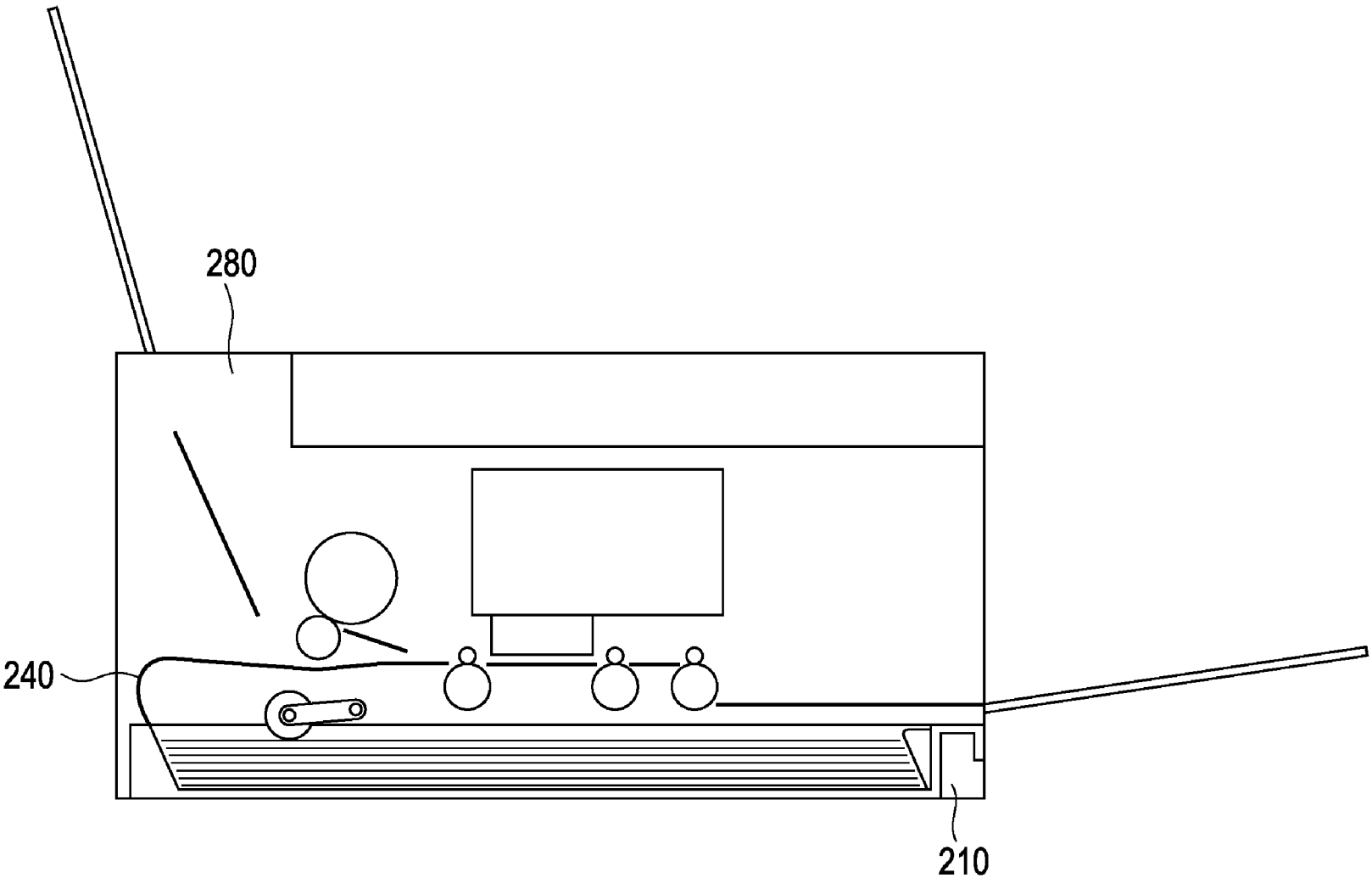
FIG. 6 PRIOR ART
FIG. 6 is a side sectional view of a conventional recording apparatus.
Figure 7:
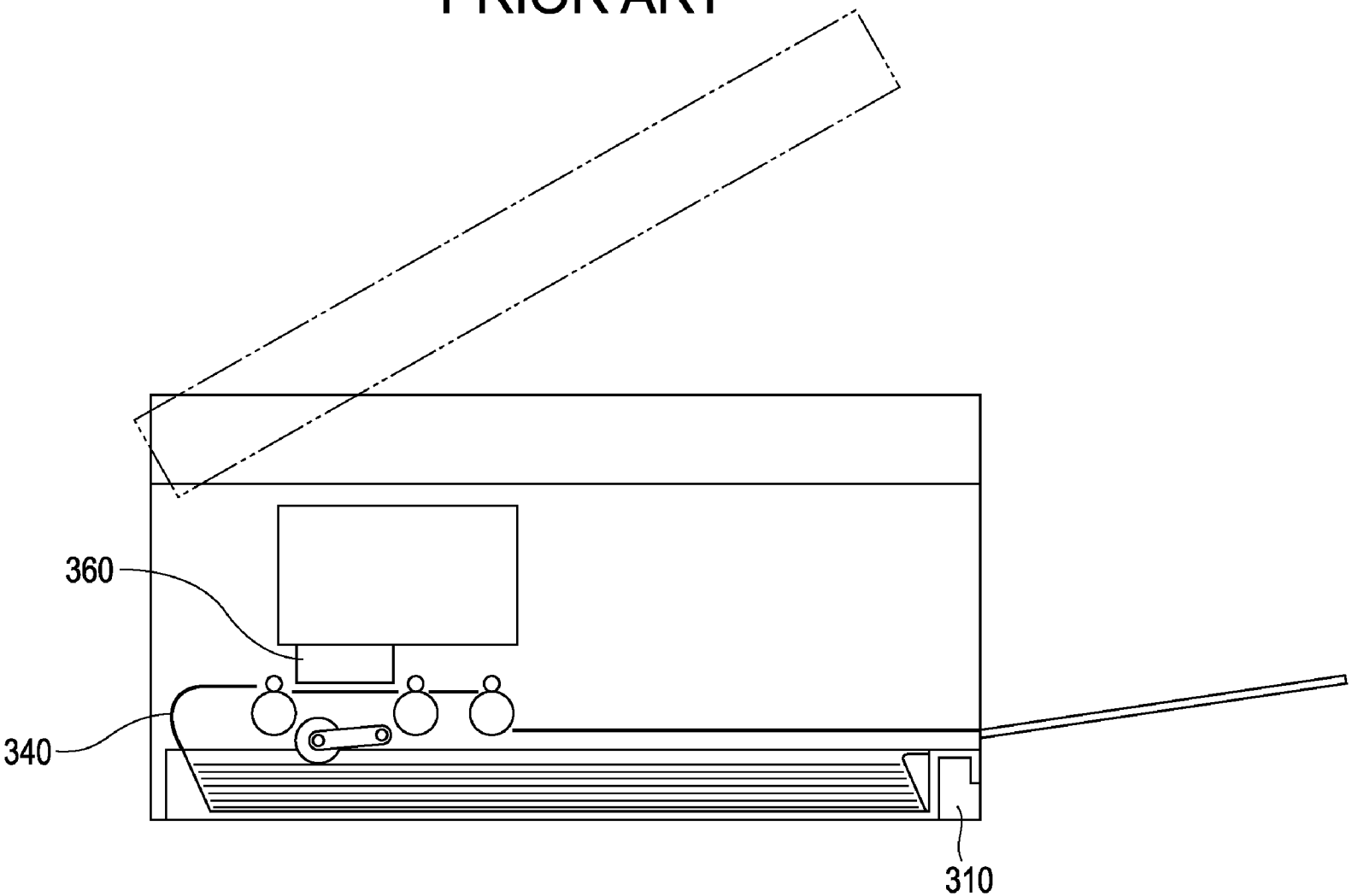
FIG. 7 PRIOR ART
FIG. 7 is a side sectional view of a conventional recording apparatus.

FIGS. 1 to 3 are side sectional views of a recording apparatus according to an embodiment of the present invention.

The recording apparatus according to this embodiment has a paper cassette 10 in which sheets are loaded, a cassette feeding roller 30 that feeds the sheets loaded in the paper cassette 10, and a U-turn conveying unit 40 that changes the conveying direction of the sheets fed by the cassette feeding roller 30. The paper cassette 10 and the cassette feeding roller 30 constitute a first paper feeding unit. In addition, the recording apparatus has a carriage (not shown), a paper output tray 71, and a second paper feeding unit 80. A recording head 60 can be attached to the carriage. The recording head 60 is supplied with ink from an ink tank 61 and performs recording on a sheet. A sheet on which an image is recorded is discharged onto the paper output tray 71. The second paper feeding unit 80 feeds sheets. The second paper feeding unit 80 has a paper tray 81 on which sheets are loaded.

FIG. 1 shows the recording apparatus in a condition in which it cannot feed paper. FIGS. 2 and 3 show the recording apparatus in a condition in which it can feed paper.

The paper cassette 10 has a sheet front edge regulating member 11 and a sheet rear edge regulating member 12. The sheet front edge regulating member 11 positions the front edges of sheets in the direction in which the paper cassette 10 is inserted into the main body of the recording apparatus. The sheet rear edge regulating member 12 positions the rear edges of sheets in the direction in which the paper cassette 10 is inserted into the main body of the recording apparatus. The sheet front edge regulating member 11 can move between a first regulating position shown in FIGS. 1 and 2 and a second regulating position shown in FIG. 3 and is disposed at one of the regulating positions. The first regulating position is the rear end of the paper cassette 10, and the second regulating position is a predetermined distance forward from the rear end of the paper cassette 10. The sheet rear edge regulating member 12 is disposed forward of the sheet front edge regulating member 11 in the paper cassette 10, can move back and forth, and is disposed at a position corresponding to the size of sheets.

To set sheets in the paper cassette 10, first, the paper cassette 10 is pulled forward and out of the main body of the recording apparatus with both ends of the paper cassette 10 along slide rails (not shown) formed in the main body of the recording apparatus. Next, the sheet front edge regulating member 11 in the paper cassette 10 is disposed either at the first regulating position or at the second regulating position.

If the sheets to use are too long in the sheet conveying direction to fit into the paper cassette 10 with the sheet front edge regulating member 11 at the second regulating position, the sheet front edge regulating member 11 is disposed at the first regulating position. If the sheets to use fit into the paper cassette 10 with the sheet front edge regulating member 11 at the second regulating position, the sheet front edge regulating member 11 is disposed at the second regulating position.

Thereafter, the sheets are loaded between the sheet front edge regulating member 11 and the sheet rear edge regulating member 12, and the sheet rear edge regulating member 12 is moved so that the sheet front edge regulating member 11 and the sheet rear edge regulating member 12 are respectively in contact with the front and rear edges of the sheets and the sheets are sandwiched between the sheet front edge regulating member 11 and the sheet rear edge regulating member 12. Next, the paper cassette 10 is inserted into the main body of the recording apparatus along the slide rails, and the setting of sheets is completed.

The paper cassette 10 can be disposed either at a first fixing position shown in FIGS. 1 and 3 or at a second fixing position shown in FIG. 2. At the first fixing position, the paper cassette 10 is fully retracted within the main body of the recording apparatus, and at the second fixing position, part of the paper cassette 10 protrudes from the front of the main body of the recording apparatus.

Above the paper cassette 10 disposed within the main body of the recording apparatus is provided a paper cassette locking lever 20, which is urged by a pressing unit (not shown) so that the tip rotates downward around a rotating shaft. Grooves 21*a* and 21*b* are formed at the top of the paper cassette 10. The tip of the paper cassette locking lever 20 engages with the groove 21*a* or 21*b*, thereby fixing the paper cassette 10 to the main body of the recording apparatus.

The paper cassette 10 is disposed at the first fixing position when the tip of the paper cassette locking lever 20 engages with the groove 21*b*, and is disposed at the second fixing position when the tip of the paper cassette locking lever 20 engages with the groove 21*a*.

When the sheet front edge regulating member 11 is disposed at the first regulating position and the paper cassette 10 is disposed at the second fixing position, the front edges in the feeding direction of the sheets loaded in the paper cassette 10 are disposed at such a position that the sheets can be fed by the cassette feeding roller 30. FIG. 2 shows this condition. When the sheet front edge regulating member 11 is disposed at the first regulating position and the paper cassette 10 is not disposed at the second fixing position, the front edges in the feeding direction of the sheets loaded in the paper cassette 10 are disposed at such a position that the sheets cannot be fed by the cassette feeding roller 30.

As described above, the recording apparatus is configured not to be able to feed paper without disposing the paper cassette 10 at the second fixing position (feedable position) when the sheet front edge regulating member 11 is disposed at the first regulating position.

When the sheet front edge regulating member 11 is disposed at the second regulating position and the paper cassette 10 is disposed at the first fixing position, the front edges in the feeding direction of the sheets loaded in the paper cassette 10 are disposed at such a position that the sheets can be fed by the cassette feeding roller 30. FIG. 3 shows this condition. When the sheet front edge regulating member 11 is disposed at the second regulating position and the paper cassette 10 is not disposed at the first fixing position, the front edges in the feeding direction of the sheets loaded in the paper cassette 10 are disposed at such a position that the sheets cannot be fed by the cassette feeding roller 30.

As described above, the recording apparatus is configured not to be able to feed paper without disposing the paper cassette 10 at the first fixing position (feedable position) when the sheet front edge regulating member 11 is disposed at the second regulating position.

In the condition of FIG. 2 or 3, the uppermost one of the sheets loaded in the paper cassette 10 is separated from the other sheets by the cassette feeding roller 30 and fed to the U-turn conveying unit 40, toward the rear of the recording apparatus. The fed uppermost sheet is conveyed and caused to U-turn along the conveying path of the U-turn conveying unit 40. Thus, the conveying direction is changed to a direction toward the front of the recording apparatus.

Thereafter, the sheet is conveyed substantially horizontally from the U-turn conveying unit 40 by a conveying roller 50 toward the front of the recording apparatus, to under the recording head 60 disposed above the conveying roller 50.

The recording apparatus is provided with a guide rail (not shown). The carriage carrying the recording head 60 can reciprocate along the guide rail extending in a direction perpendicular to the sheet conveying direction. The recording head 60 mounted on the reciprocating carriage discharges ink onto the sheet conveyed to under the recording head 60, thereby recording an image. The sheet on which an image is recorded is discharged by discharge rollers 70 provided in front of the conveying roller 50 onto the paper output tray 71 in the front of the recording apparatus and retained there.

The paper output tray 71 has a rotating shaft supported by the main body of the recording apparatus. The paper output tray 71 can be rotated around the rotating shaft upward from a loadable position in which sheets can be discharged onto the paper output tray 71. So, the paper output tray 71 can be folded and disposed at the retracted position so that the loading surface onto which sheets are discharged abuts on the outer surface of the main body of the recording apparatus. Discharged sheets can be loaded on the paper output tray 71 only when the paper output tray 71 is disposed at the loadable position. When the paper output tray 71 is not disposed at the loadable position, sheets are not discharged from the main body of the recording apparatus. As described above, when the recording apparatus is used, the paper output tray 71 protrudes forward from the recording apparatus, and when the recording apparatus is not used, the paper output tray 71 can be folded and disposed at the retracted position. So, space can be saved when the recording apparatus is stored.

When the paper output tray 71 is disposed at the retracted position, the paper output tray 71 blocks the opening of a paper discharge unit, thereby protecting the inside of the recording apparatus, for example, from the dust. Thus, the malfunction of the recording apparatus can be prevented.

The recording apparatus has the second paper feeding unit 80 above the U-turn conveying unit 40 and can feed the sheets set in the paper feeding tray 81 of the second paper feeding unit 80 in preference to the sheets set in the paper cassette 10. So, it is possible to set frequently-used sheets (for example, plain paper) in the paper cassette 10, to set another kind of sheets (for example, gloss paper or postcards) in the paper feeding tray 81, and to preferentially feed the other kind of sheets. When the other kind of sheets are used, it is not necessary to take out the frequently-used sheets from the paper cassette 10 and to then set the other kind of sheets in the paper cassette 10. Thus, the operability is improved.

The paper feeding tray 81 has a rotating shaft supported by the main body of the recording apparatus. By rotating the paper feeding tray 81 forward around the rotating shaft, the paper feeding tray 81 can be folded so that the surface on which sheets are loaded abuts on the top surface of the main body of the recording apparatus. As described above, when the recording apparatus is used, the paper feeding tray 81 protrudes obliquely upward from the recording apparatus, and when the recording apparatus is not used, the paper feeding tray 81 can be folded. So, space can be saved when the recording apparatus is stored.

When the paper feeding tray 81 is folded, the paper feeding tray 81 blocks the opening of the second paper feeding unit 80, thereby protecting the inside of the recording apparatus, for example, from the dust. Thus, the malfunction of the recording apparatus can be prevented.

In addition, the recording apparatus has a document reader unit 90 that has a document reading function. The document reader unit 90 is disposed forward of the second paper feeding unit 80. The recording apparatus can store image data read by the document reader unit 90 in a memory inside the recording apparatus, transmit the image data to a personal computer connected to the recording apparatus, or record the image data with the recording head of the recording apparatus.

The document reader unit 90 has a rotating shaft in the rear thereof. The rotating shaft is supported by the main body of the recording apparatus. By rotating the document reader unit 90 upward around the rotating shaft, an operator can access the inside of the recording apparatus. So, the operator can easily replace ink or remove jammed paper. Thus, the ease of maintenance is improved.

The recording apparatus has a driving unit 101 and a sensor 102. The driving unit 101 moves the paper cassette 10 between the first fixing position and the second fixing position. The sensor 102 detects whether the sheet front edge regulating member 11 is disposed at the first regulating position or at the second regulating position.

In the recording apparatus, when a paper feed instruction is issued and a paper feed operation is started, if the sensor 102 detects that the sheet front edge regulating member 11 is disposed at the first regulating position, a control unit 100 receives a signal from the sensor 102 and activates the driving unit 101. After the driving unit 101 has moved the paper cassette 10 from the first fixing position to the second fixing position (feedable position), paper feeding is started. In the recording apparatus, when a paper feed instruction is issued and a paper feed operation is started, if the sensor 102 detects that the sheet front edge regulating member 11 is disposed at the second regulating position, paper feeding is started with the paper cassette 10 disposed at the first fixing position (feedable position). As described above, in the recording apparatus, when a paper feed instruction is issued and a paper feed operation is started, the cassette feeding roller 30 can be prevented from feeding sheets with the paper cassette 10 disposed at the unfeedable position.

As described above, portions protruding from the main body of the recording apparatus can be eliminated without lengthening the sheet conveying path or disposing the recording head in the rear of the recording apparatus and without sacrificing the second paper feeding unit. Thus, the recording apparatus according to this embodiment has a space-saving footprint without sacrificing the recording speed, ease of maintenance, and operability.

In the above-described configuration, when a paper feed instruction is issued and a paper feed operation is started, the sensor 102 detects the position of the sheet front edge regulating member 11 and the fixing position of the paper cassette 10 is automatically changed to the feedable position by the driving unit 101. However, the recording apparatus of the present invention can have any other configuration as long as it can prevent the cassette feeding roller 30 from feeding sheets with the paper cassette 10 disposed at the unfeedable position when a paper feed instruction is issued and a paper feed operation is started.

For example, the recording apparatus of the present invention can have a configuration such that, when a paper feed instruction is issued and a paper feed operation is started, if the paper cassette 10 is disposed at the unfeedable position, an error message is displayed and the cassette feeding roller 30 is not activated. An operator can thereby find that the paper cassette 10 is disposed at the unfeedable position, reset the paper cassette 10 at the feedable position, and then perform recording on sheets.

Alternatively, the paper cassette 10 may be moved from the first fixing position to the second fixing position in conjunction with the operation to move the paper output tray 71 from the retracted position to the loadable position by rotating it forward.

That is, the recording apparatus of this embodiment may have a cam (not shown) or a gear (not shown) serving as an interlocking drive mechanism that transmits the drive force of forward rotation of the paper output tray 71 disposed at the retracted position to the paper cassette 10. The drive force of forward rotation of the paper output tray 71 is transmitted to the paper cassette 10 through the interlocking drive mechanism. The paper cassette 10 is moved by the drive force from the first fixing position to the second fixing position. The sheet front edge regulating member 11 is prevented from moving from the first regulating position.

When the paper output tray 71 is disposed at the retracted position, the paper cassette 10 is disposed at the first fixing position (unfeedable position). When the paper output tray 71 is being rotated, the paper cassette 10 is being moved from the first fixing position to the second fixing position. When the paper output tray 71 is disposed at the loadable position, the paper cassette 10 is disposed at the second fixing position (feedable position).

Thus, the paper cassette 10 is disposed at the feedable position only when the paper output tray 71 is disposed at the loadable position. By preventing the recording apparatus from operating when the paper output tray 71 is disposed at the non-loadable position, the cassette feeding roller 30 can be prevented from feeding sheets with the paper cassette 10 disposed at the unfeedable position.

Although, in the recording apparatus according to this embodiment, the paper output tray is foldable, the paper output tray may be fully retractable within the main body of the recording apparatus. In this case, the paper cassette may be moved from the first fixing position to the second fixing position by an interlocking drive mechanism (not shown) in conjunction with the operation to move the paper output tray from the retracted position within the main body of the recording apparatus to the loadable position.

The embodiment of the present invention can provide a recording apparatus that has a space-saving footprint without sacrificing the recording speed, ease of maintenance, and operability.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-323327 filed Dec. 14, 2007, which is hereby incorporated by reference herein in its entirety.

What is claimed is:

1. A recording apparatus having a main body, comprising:

a feeding unit that feeds recording media;

a conveying roller disposed within the main body of the recording apparatus for conveying the recording media;

a conveying path disposed within the main body of the recording apparatus for conveying the recording media fed by the feeding unit to the conveying roller;

a loading unit in which recording media are loaded; and a fixing unit for fixing the loading unit at a first position where the loading unit is fully retracted within the main body of the recording apparatus while the recording media are loaded therein and for fixing the loading unit at a second position where the recording media loaded in the loading unit can be fed by the feeding unit, wherein when the loading unit is disposed at the first position the front edges in the feeding direction of the recording media in the loading unit are disposed beyond the conveying path from the feeding unit, wherein when the loading unit is disposed at the second position a part of the loading unit protrudes from the main body of the recording apparatus, wherein when the loading unit is disposed at the second position, the recording media fed by the feeding unit can be conveyed by the conveying path.

2. The recording apparatus according to claim 1, wherein the loading unit is configured to be inserted into the main body of the recording apparatus in a direction.

3. The recording apparatus according to claim 1, further comprising a driving unit that moves the loading unit between the first position and the second position, and wherein, when the loading unit is disposed at the first position, the driving unit moves the loading unit to the second position before the feeding unit starts to feed the recording media.

4. The recording apparatus according to claim 1, further comprising a paper output tray on which recording media discharged from the main body are loaded and a driving unit that moves the loading unit in conjunction with a movement of the paper output tray, and wherein the paper output tray can move between a loadable position where recording media discharged from the main body can be loaded and a retracted position, and the driving unit moves the loading unit from the first position to the second position in conjunction with the movement of the paper output tray from the retracted position to the loadable position.

5. The recording apparatus according to claim 4, wherein, when the paper output tray is disposed at the retracted position, a loading surface of the paper output tray abuts on the outer surface of the recording apparatus.

6. The recording apparatus according to claim 4, wherein, when the paper output tray is disposed at the retracted position, the paper output tray is fully retracted within the main body.

7. The recording apparatus according to claim 1, wherein the loading unit has a regulator that regulates the positions of one or more edges of each of the recording media loaded in the loading unit, and the regulator can move between a first regulating position where the regulator positions an edge of the each of the recording media at an end of the loading unit and a second regulating position where the regulator positions the edge of the each of the recording media at such a position that the recording media can be fed by the feeding unit when the loading unit is disposed at the first position.

8. The recording apparatus according to claim 7, further comprising a driving unit that moves the loading unit between the first position and the second position.

* * * * *